US005887873A

United States Patent [19]

Freeman

[11] Patent Number: 5,887,873

[45] Date of Patent: Mar. 30, 1999

[54] UNIQUE DECK OF PLAYING CARDS

[76] Inventor: Jon Freeman, 1408 Redwood Dr., Los Altos, Calif. 94024-7248

[21] Appl. No.: 915,822

[22] Filed: Aug. 21, 1997

[51] Int. Cl.[6] ..... A63F 1/00

[52] U.S. Cl. ..... 273/303; 273/304; 273/305; 273/306; 273/296

[58] Field of Search ..... 273/303–306, 273/292, 296

[56] References Cited

U.S. PATENT DOCUMENTS

| | | | |
|---|---|---|---|
| 171,978 | 1/1876 | Black | 273/305 |
| 198,217 | 12/1877 | Saladee | 273/305 |
| 1,448,441 | 3/1923 | Haas | 273/305 |
| 1,632,941 | 6/1927 | Abell | 273/303 |
| 4,006,906 | 2/1977 | Gruber | 273/292 |
| 5,224,706 | 7/1993 | Bridgemann et al. | 273/292 |

OTHER PUBLICATIONS

*Hoyle's Modern Encyc. of Card Games* 1974 Gibson, Walter B. pp. 1–3 et seq. (book).

*A Player's Guide to Table Games* 1975 Jackson, John pp. 24–25 (book).

*Official World Encycl. of Sports & Games* 1979 Diagram Visual Information Ltd. pp. 58–59 116–117 et al. (book).

"Contract Bridge", Scarne's Encyclopedia Of Games, Harper & Row, Publishers, pp. 118–124. Dec. 1973.

*Primary Examiner*—Benjamin H. Layno

[57] ABSTRACT

A deck of cards, tiles, or similar playing pieces, real or simulated on a computer or other device, chiefly characterized by a trilateral organization comprising three independent aspects: suit, value, and color or color group. The plurality of cards representing each element of each aspect comprise approximately equal pluralities of each element of each of the other aspects. Except for auxiliary cards, each card in a single deck represents a unique combination of a single suit, a single color group, and a single value or rank. The preferred form of the invention is a series of related triadic decks of playing cards comprising three suits and three color groups (20R, 20G, 20B), nonsexist or gender-neutral picture cards (22, 24), an improved layout, and indicative card backs (32). The layout improvement typically involves additional set designation markers (16) in the two commonly vacant corners of a card face (FIG. 2A). Backs (32) are uniform for all cards in a deck but different from deck to deck; the use of the elements of the back (26, 28, 30) is sufficient to remind a player of the general configuration of the deck being used (FIGS. 4A to 4D).

17 Claims, 4 Drawing Sheets

UNIQUE DECK OF PLAYING CARDS

BACKGROUND

1. Field of the Invention

This invention relates to card games, specifically the packs of cards or tiles used to play such games.

2. Prior Art

A conventional 52-card pack of playing cards is almost certainly the greatest invention in the history of games. It is compact, lightweight, portable, inexpensive, instantly familiar, and the basis for a staggering variety of games, including many of the most popular ever: bridge, poker, rummy, and a multitude of solitaire games. It has not changed significantly for hundreds of years.

Although its flaws are disguised by familiarity and sanctified by tradition, a conventional deck of cards is not perfect.

For example, the number of cards in a standard deck is arbitrary and awkward. Since its factors are only two, four, and 13, a 52-card deck cannot be dealt out evenly among three, five, or six players. This limits the kind of games three or five people can play and, often, alters the game play (by omitting certain cards to make the deal come out even) for different numbers of players.

A conventional deck lacks the special or auxiliary cards many games (euchre, skat, klaberjass, some forms of poker, etc.) require. This forces other cards (typically jacks, often deuces, sometimes others) into roles for which they are ill-suited. The confusing rules and asymmetrical rankings that result make such games hard to learn and limit their appeal.

The symbology of traditional suits and ranks, especially the face cards, is outdated and somewhat sexist. It lacks both contemporary relevance and the romance of fantasy.

Most essentially, a hand of cards is subject to the whimsy of chance. In most games, a bad hand is a huge, often overwhelming disadvantage. This is commonly assumed to be inherent in the nature of card games and not, therefore, capable of being corrected or ameliorated. To consider it a problem of the nature of the cards themselves requires stepping outside the traditional paradigm, a feat few people are inclined to do.

The layout of a conventional card face is not ideal. Stacking secondary indicia in the upper left corner is handy for sorting cards held in the hand. However, the vertically overlapped cards typical of solitaire games must be separated enough to view both value index and suit marker. This sharply limits the size of the possible tableaux (game formations) or, in computer displays, the size of the cards. More compressed card stacks force players to remember or guess the suits involved or to peek periodically at the concealed suit markers. A truly satisfactory solution requires an improved card face.

Most attempts at changing the layout of conventional cards seem to involve esthetic more than practical considerations. An exception is U.S. Pat. No. 198,217 to Saladee (1877), which offers two imperfect solutions to the solitaire problem. The first is an enlarged set of secondary indicia in which numbers (value indexes) are on, not above, suit markers. The advantage of this approach is substantially reduced by the need for extremely tiny numbers or exceptionally large suit symbols. The former would be hard to read, especially in computer simulations; the latter would occupy most of the space to be saved. The second approach includes, at each corner, a pair of suit markers surrounding a value index. While this arrangement would allow more compressed stacks of cards, it uses more indicia than necessary. Limiting the secondary indicia to two diagonally opposite corners results in two overcrowded corners and two empty ones, an inefficient use of space that unnecessarily confines the primary indicia, which should be centered.

Even the advantages of conventional cards can be a drawback to computer-game publishers. Lacking copyright protection, traditional card games can be duplicated readily by other companies. It is hard for a marketing campaign to distinguish a solid, professional rendition from the crudest shareware effort. Millions play card games on computer, but selling card games successfully seems to require a new foundation.

Despite the disadvantages of a conventional deck, the only two traditional alternatives are of limited utility. A tarot deck, from which the modern deck evolved, has four suits and 22 auxiliary cards (the major arcana) that can serve as something of a fifth suit. A mah jong set is a quadruple deck of 136–144 tiles; it has three suits and 28–36 auxiliary tiles. Both sets are too unwieldy for a general-purpose deck, with far too many auxiliary pieces for most games. Colors are undeveloped, being neither clearly associated with suits nor fully independent.

The only modern competitor to achieve substantial commercial success was Parker Brothers' popular Rook card deck, which used colors as suits but was otherwise quite similar to a conventional deck. Like attempts to assign a different color to each of the four standard suits, this approach is actually less flexible than having two colors and four suits. (In solitaire games, alternating colors differs from alternating suits; with a Rook deck, they are equivalent.)

There have been surprisingly few attempts at substantively changing the organization of a deck of cards. U.S. Pat. No. 1,448,441 to Haas (1923) shows four suits, two pairs distinguished by symbol and two distinguished by color. The intent is not to create fully functional color groups equivalent to, but independent from, suits. Instead, the patent uses suit symbols, color, and two sets of values to create subsets and supersets of suits. In trick-taking games (the obvious focus of the patent), this construction allows trump to be a suit, two suits, or even half a suit. In melding, discarding, gambling, and solitaire games, there seems little advantage to the arrangement, and a deck of 65 cards is numerically even more awkward than one of 52.

U.S. Pat. No. 4,006,906 to Gruber (1977) discloses a specific game using a 121-card deck that seems to separate color and suit. However, nothing in the patent specifies that suit, color, and rank must be genuinely independent, and their exact relationship remains obscure. The deck is much too large for general use, and most standard games have no need of the patented game's implied restrictions on suit symbols.

The previously overlooked U.S. Pat. No. 1,632,941 to Abell (1927) discloses a specific game using a 60-card deck that separates color and suit but, as in Haas, fails to make them equivalent. Instead, color groups are suits, and "spot suits" are effectively subsuits, whose primary purpose is perhaps to add complexity to a poorly conceived scoring system, but whose actual primary function is to complicate and confuse card ranking. In Abell's scheme, in which both "spot suits" and "color suits" are ranked or ordered (the former by geometric shape, the latter by an arcane system not even Abell can explain), a Three could be higher than a Four but lower than a Deuce—and vice versa. This unintuitive arrangement—confusing to one "of average skill in the art" and utterly baffling to prospective players—is enough to deter even the minuscule audience for an invention aimed at making contract bridge "more complex." Far from appreciating the great advantage of separating color and suit—the flexibility to be gained by making them equal—Abell is stratified and inflexible. While the deck's size is "convenient," the exact number of cards (60) seems a happy accident, and the major advantage thereof (divisibility among two-to-six players: in a word, flexibility) is squandered on a game for four people—the one group whose needs are met by a conventional deck. Unsurprisingly, Abell leaves no legacy for today's card games.

OBJECTS AND ADVANTAGES

Accordingly, several objects and advantages of my invention are

- to provide a commercially viable alternative to a conventional card deck;
- to provide a new and improved deck of cards capable of serving as the basis for a multitude of card games;
- to provide a deck of cards genuinely suitable for use by two, three, four, five, or six players and most particularly by three players, who are given short shrift by a conventional card deck and most common card games;
- to provide a deck of cards that can be used not only to play standard types of card games but also, without adding specialized sets of indicia or otherwise distorting the card faces, to play common dice games and even games approximating dominoes;
- to provide a deck of cards with a reasonable number of auxiliary cards;
- to provide a meaningful symbology that offers the power of archetypes and the interest of fantasy;
- to provide a deck of nonsexist or gender-neutral cards or tiles;
- to reduce the effects of chance on the play of various games by providing alternative ways to organize or use the cards in a hand;
- to provide an improved card-face layout more suitable to a wide range of solitaire games; and
- to provide a more flexible organization for a deck of cards by making suit, color, and value independent.

Further objects and advantages of my deck include providing novel features, terminology, and images; providing user-friendly card faces and backs that make card and game features more obvious while being more appropriate for computer simulations; providing related decks of cards of varying configuration, some of which can be used to play games similar to those otherwise requiring large or specialized sets of playing pieces; making cards more interrelated, thereby increasing scoring possibilities, average hand values, and positive-sum decision-making during game play, especially in melding games; and providing the basis for an ongoing series of copyrightable, inexpensive, easily distributable, mass-market computer games.

DRAWINGS FIGURES

Reference Numerals in Drawings

| | | | |
|---|---|---|---|
| 10 | primary indicia | 12 | set of secondary indicia |
| 14 | value index | 16 | set designation marker (suit marker) |
| 18 | background | 20B | blue cards |
| 20G | green cards | 20R | red cards |
| 22 | normal picture cards | 24 | auxiliary cards (jokers) |
| 26 | background pattern | 28 | product title logo |
| 30 | crown symbol | 32 | card back |
| 34 | card name banner | | |

SUMMARY

The present invention is essentially a collection of playing pieces, suitable for use in a multitude of games, and characterized by three independent aspects: suit, color, and value. The preferred form is a series of related triadic decks of playing cards utilizing three suits and three colors, an improved layout, indicative backs, and nonsexist or gender-neutral picture cards.

Description of a Basic Deck of Number Cards—FIGS. 1, 2A to 2D, 7A My invention is a trilateral deck of cards, tiles, or similar playing pieces (actual or simulated on a computer, videogame console, or other electronic device). The typical, preferred form is analogous to, but different from, a conventional 52-card pack of playing cards.

All possible forms of my invention share at least one essential feature in common: a trilateral organization. They all have three independent aspects ("dimensions" or ordering sets): suit, color, and value (number or rank). The first two are primary aspects; value, having less importance organizationally, is considered a secondary aspect. All three aspects are shown on the faces of the cards or pieces; the backs of all pieces in the same deck are identical.

Besides being trilateral, preferred forms of my deck (and the only ones discussed in detail) are also triadic: they have three suits and three colors, and there are three—or a multiple of three—playing pieces (cards) of each value.

Figure 1:
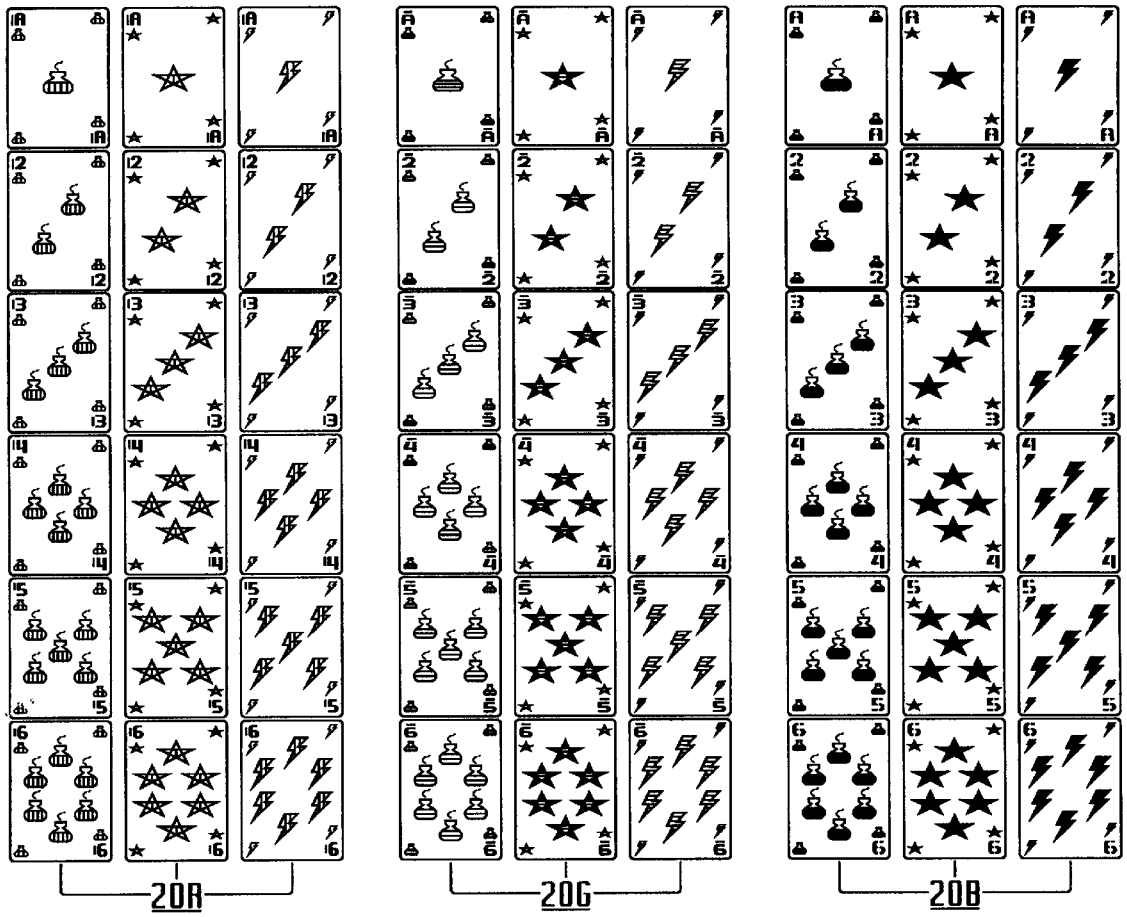
FIG. 1 shows a simple overhead view of a novel deck of playing cards, a basic version of the invention.

The simplest version of a typical embodiment is a basic deck of playing cards (FIG. 1). This basic deck comprises 54 number cards, divided (separately and independently) into three suits of 18 cards each, three color groups of 18 cards each, and six values of nine cards each. (Put differently, there are six ranks, and nine cards of each rank.)

While the color of a conventional playing card is dependent on its suit, in my decks suit does not determine color. The set of red cards 20R is, except for color, identical to the set of green cards 20G or blue cards 20B. In the basic deck, every suit includes six cards (one of each value) of each color; every color group includes six cards (one of each value) of each suit. Each suit contains three aces (one in each color); each color group also includes three aces (one of each suit).

Each card in the basic deck represents a unique combination of a single suit, a single color, and a single value.

Conversely, every one of the 54 such combinations of three suits, three colors, and six values is present in the basic deck. If each value includes every combination of suit and color in the deck, as in this case, the deck is said to be perfect. (Imperfect decks will be discussed later.)

In the preferred embodiment shown, the three suits are identified, respectively, by indicia in the form of laboratory beakers or flasks, five-pointed stars or pentacles, and stylized thunderbolts or lightning bolts. The three preferred colors are red, green, and blue, because those three colors are the simplest and purest colors displayed by a typical personal computer. The six values (numbers) represented in the basic deck are ace (one), two, three, four, five, and six.

The only truly essential elements of a playing piece's face are primary indicia 10 (black, white, or colored) on a contrasting background 18 (shown most simply in FIG. 7A, discussed later). Following convention, preferred forms of my deck use colored indicia (usually red, green, or blue) on a white background. (For visual clarity and esthetic appeal, in preferred forms each color comprises two shades, and pips are outlined in black, but the predominant or identifying color is obvious.)

The primary indicia 10 of a number card or tile commonly take the form of a set of pips that serves as a microcosm of the trilateral deck. The shape of the pips denotes a card's suit. The color of the pips indicate a card's color and color group. The number of pips designates a card's value.

To aid in holding cards in the hand, playing cards usually include additional, secondary indicia. FIGS. 2A to 2D show in close-up four variations of the face of a typical number card from my basic deck. All include two standard sets of secondary indicia 12, each of which comprises a value index 14 and a set designation marker 16 (usually—and usually called—a suit marker). In all cases, the two elements of each standard set are adjacent and vertically aligned along a side (vertical) edge; each index 14 is closer to a corner than its paired marker 16 is; and the two standard sets are in diagonally opposite corners. In all but the version in FIG. 2C, those occupied corners are the upper left and lower right corners, as in conventional playing cards.

In the basic deck, markers 16 are essentially pips of smaller size; their shape similarly denotes a card's suit. The color of the secondary indicia also reflects a card's color and color group. Index 14 takes the form of an alphanumeric character indicating a card's rank (as with an ace) or number.

Figure 2A:
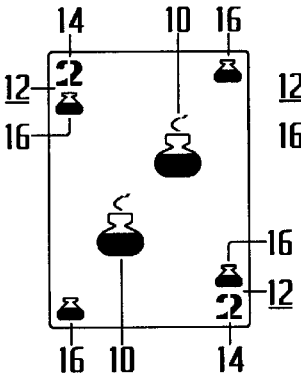
FIGS. 2A to 2D show, in detail, four different versions of a representative number card.
Figure 2B:
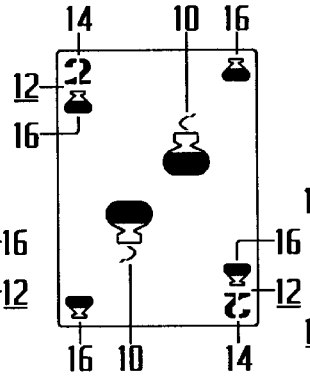
Figure 2C:
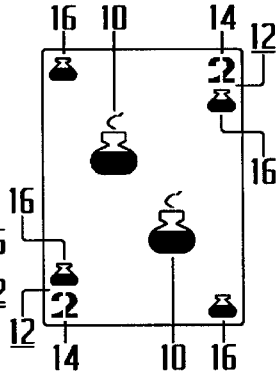

In the conventionally symmetrical card face shown in FIG. 2A, all of the lower indicia are inverted. In the preferred form shown in FIG. 2B, all indicia share a common orientation: that is, all indicia are "right-side-up." This layout is particularly suited to computer simulations, since cards on a computer are never upside-down. (A card can be turned over, so that its face is hidden, but the top and bottom edges are never reversed.) FIG. 2C is simply a mirror image of FIG. 2B, with the two sets of secondary indicia 12 disposed in the upper right and lower left corners. This layout lacks the familiarity of FIG. 2B but is equally functional.

Figure 2D:
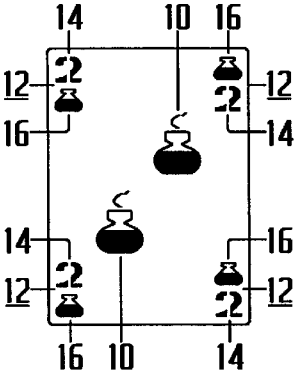

In addition to conventional indicia, all standard forms of my cards also include an improvement: an extra pair of set designation markers 16 in the otherwise unoccupied corners, in positions comparable to, but opposite, those of indexes 14. In FIGS. 2A and 2B, the extra markers 16 occupy the upper right and lower right corners. In FIG. 2C, the extra markers are in the upper left and lower right corners. In FIG. 2D, the two extra markers 16 are joined by two extra indexes 14 to form two reversed (but not inverted) sets of secondary indicia 12.

Figure 3A:
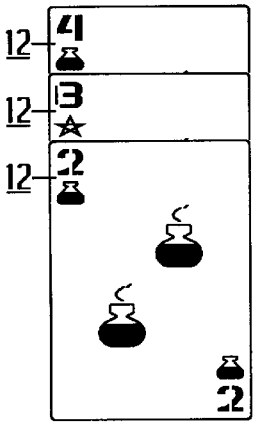
FIGS. 3A and 3B show, in close-up, two different ways to arrange an overlapping stack of cards.
Figure 3B:
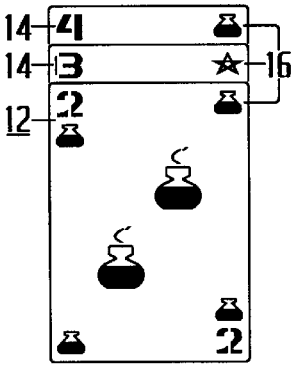

Operation of a Basic Deck of Number Cards—FIGS. 1, 3A, 3B

The basic deck shown in FIG. 1 can be used to play a multitude of games in much the same fashion as conventional cards. It is particularly well suited to solitaire and introductory games.

In solitaire games, successive cards in a tableau (arrangement) could alternate—or match—suits, colors, either, or both. Aces count as ones and typically serve as foundations, which can be built up in color, suit, or both at once. This flexibility makes it easy to tailor games for diverse levels of difficulty.

Discarding or melding games could require players to match suit, color, rank, or any combination. Trick-taking games could be played in suits, colors, or either, depending on the game rules or the choice of the dealer or high bidder. As with conventional cards, aces are commonly low in the former group and high in the latter.

Since there are three aces (and three cards of every other rank) in each suit or color, determining the highest card in a trick is more difficult than with a conventional deck. There are several schemes available to resolve conflicts; the default case follows the example of pinochle and gives precedence to the first-played card of the same value.

Since the basic deck includes an equal number of cards of each of six values, it can also be used to play dice games or, with a bit of imagination, games analogous to dominoes.

The operation of the improved layout is shown in FIGS. 3A and 3B, which show a column of overlapping cards such as might occur in many forms of solitaire. Cards with a conventional layout (without extra set markers 16) need the greater spacing (that is, less overlap) shown in FIG. 3A to enable players to see both the value and the suit of each card in the stack. That may not allow enough room on a table top or computer screen for solitaire games with elaborate tableaux. The improved layout shown in FIG. 3B saves space by allowing greater overlap in a stack of cards; this allows larger cards (on a computer) or more elaborate tableaux with more piles on the same size table or screen.

Description of Master and Member Decks and Indicative Backs—FIGS. 4A to 4D To accommodate different numbers of players and the widest possible range of games, several variations of my deck coexist. These variations or member decks are essentially subsets of an overall superset of cards called a master deck. Master and member decks are trilateral, and their primary aspects (suit and color) are necessarily the same, but the master deck's set of values is potentially greater than any member deck's. The preferred master deck has the same three suits and three colors as the basic deck (a member deck) discussed above.

Each member deck is unique. Member decks vary in the values they comprise, the number of cards they contain, and the number of cards in each suit, color group, or value. A typical member deck comprises 48–72 cards. A practical minimum is about 18–20 cards; the maximum for a single deck is perhaps 100 cards, but double decks can be larger.

A member deck can be single or double, perfect, imperfect, or pluperfect. Imperfect and pluperfect decks are discussed separately, below. A single deck (such as the basic deck of FIG. 1) is a member deck consisting entirely of unique cards; there are no duplicates. Conversely, a double deck contains two copies of every card, like a pinochle deck.

The cards of each member deck have a common back. However, to reduce the confusion caused by new games, new cards, and different decks, preferred forms of my deck use different indicative backs for each member deck. (As a practical matter, this feature is easier to implement consistently on a computer than with real cards.)

FIGS. 4A to 4D show the preferred card backs for four different member decks. Each comprises a design and a color scheme. Design elements include a background pattern 26 (typically different for each single deck), a product title logo 28, and one or more crown symbols 30. The preferred color scheme includes black, white, shades of gray, and a dominant or indicative color: blue for all single decks, reddish-brown for double decks.

Figure 4A:
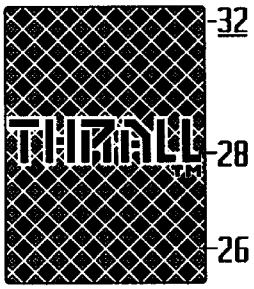
FIGS. 4A to 4D show, in detail, four different card backs.

The preferred back for the basic deck of FIG. 1 is shown in FIG. 4A. Pattern 26 comprises alternating blue and gray diamonds. Logo 28 is horizontal.

Figure 4B:
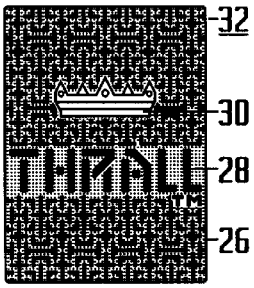

FIG. 4B shows the back of a standard deck that includes six picture cards. The design adds a crown 30 to pattern 26 (here, a maze) and logo 28.

Figure 4C:
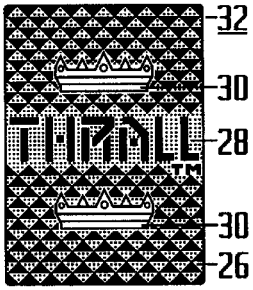

FIG. 4C, the back of a reinforced deck with 18 picture cards, is similar. Pattern 26 alternates blue and gray triangles; there are two crowns 30, one above and one below logo 28.

Figure 4D:
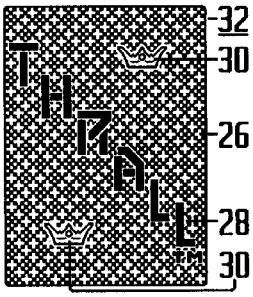

FIG. 4D shows the preferred back of a reduced deck (FIG. 8), one kind of an imperfect deck. It contains two small crowns 30 on a batique pattern 26. Logo 28 is disposed diagonally from the upper left to the lower right.

Operation of Master and Member Decks and Indicative Backs—FIGS. 4A to 4D Any reasonable member deck can be used to play a variety of card games. Since no game should require more than one member deck, all the cards used in any game should have identical backs. While no information about a specific card is revealed by its back, indicative backs can remind players whether there are, for instance, three, six, nine, 12, or 18 aces available in the game they are playing. Since my member decks and games employing them will be at least initially unfamiliar, such general information can be quite helpful.

In preferred implementations, a back without crowns (as in FIG. 4A) indicates a deck composed solely of number cards. One crown 30 (as in FIG. 4B) designates a single deck with the six picture cards shown in FIG. 5 or a double deck with two copies of each such card. Two crowns on the back (FIGS. 4C and 4D) similarly designate a deck with 18 different picture cards.

A horizontal logo 28 (FIGS. 4A to 4C) indicates a perfect or pluperfect deck that includes a perfect set of number cards. A diagonally disposed logo 28 indicates an imperfect deck (one with less than nine aces in a single deck, if we assume the preferred master deck of three suits and three color groups). If an imperfect deck is a reduced deck (leaving six aces in the typical example shown in FIG. 8), the diagonal logo 28 is black (FIG. 4D). A white diagonal logo 28 indicates a depleted deck (with only three aces in the typical deck shown in FIG. 9).

Figure 5:
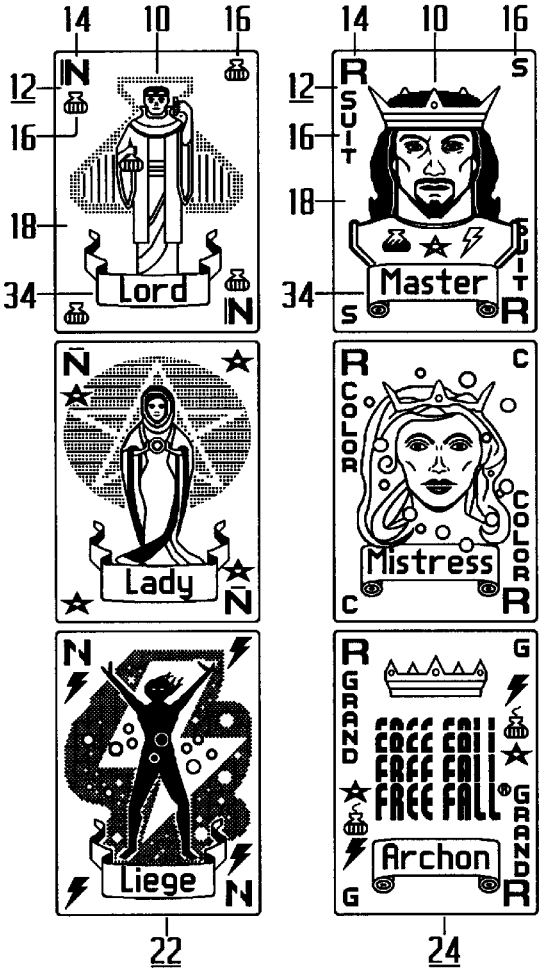
FIG. 5 is a close-up view of a group of picture cards.

Description of a Standard Deck with Picture Cards—FIGS. 1 and 5

As shown in FIG. 5, picture cards differ from number cards in several ways. Primary indicia 10 are not pips but, rather, a picture or image of a building, weapon, or other object; a nonsuit symbol; a plant or animal (real or imaginary, living or extinct); or a human or humanoid figure: male, female, or neuter. Neuter figures include both the specifically sexless and those whose gender identity is obscure or hidden by clothing, armor, or other elements. (In preferred implementations, all ranks have a balance of distinctly male and distinctly female figures.) Since my cards typically have a distinct top and bottom, each picture card bears a single image (not doubled, as on conventional face cards). Because both cards and images are unfamiliar to most players, primary indicia 10 is further identified by a card name banner 34. Index 14 is a letter, not a number, and marker 16 is not always a symbol.

The preferred standard deck contains 60 cards: the 54 number cards of the basic deck (FIG. 1) and the six picture cards shown in FIG. 5. Included are three normal picture cards 22 (with a value index 14 of "N") and three auxiliary cards 24 (with an index 14 of "R"). Because it comprises a perfect set of number cards and an imperfect set of picture cards, the standard deck is pluperfect.

The left column of FIG. 5 depicts three normal picture cards 22. All have the same value, but each represents a different color and suit. The first (with a card name banner 34 marked "Lord") has red indicia, including a male human figure as primary indicia 10 and four of the first suit's markers 16 (beakers). The second card (the "Lady") has green indicia, including a female human figure as primary indicia 10 and four of the second suit's markers 16 (pentacles). The third card (the "Liege") has blue indicia, including a neuter humanoid figure as primary indicia 10 and four of the third suit's markers 16 (thunderbolts).

Three auxiliary cards 24—"ruling" jokers—are shown in the right column of FIG. 5. Their common rank is different from that of any normal picture card. Their secondary indicia are black, and their set designation markers 16 are specifically set markers, not suit markers; instead of suit symbols, their markers 16 take the form of words or one-letter abbreviations.

The first joker bears a banner 34 marked "Master." A crowned man bearing symbols of all three suits serves as its primary indicia 10. The image is rendered predominantly in black, with none of the preferred deck's three identifying colors. Its markers 16 are the word "SUIT" or the letter "S."

A crowned woman with no suit symbols serves as the primary indicia 10 of the second joker (the "Mistress"). The image is rendered in all three identifying colors, and its markers 16 are the word "COLOR" or the letter "C."

The primary indicia 10 of the third joker (the "Archon") comprise a developer's trademarked logo, a crown, and all three suit symbols, each rendered in a different identifying color. This card's markers 16 are the word "GRAND" or the letter "G."

Operation of a Standard Deck with Picture Cards—FIGS. 1 and 5

Like a conventional 52-card pack or my basic deck, the standard deck shown, in combination, by FIG. 1 and FIG. 5, can be used to play a multitude of games. Because it can be dealt out evenly among two, three, four, five, six, or even 10, 12, 15, or 20 players, it is the preferred member deck for most multiplayer games.

In general, contrary to the conventional case, picture cards outrank all number cards, even aces. In counting games, picture cards share a numerical value (typically 7); in most other cases, normal picture cards 22 serve as the highest-valued ordinary cards of their respective suits and color groups but are outranked by the more unusual auxiliary cards 24. In melding games, the two sets of picture cards serve as (separate) melding groups, regardless of other possible functions.

The role of auxiliary cards 24 depends greatly on the rules of specific games. In games with a trump suit or color, the ruling jokers usually serve as the highest trump cards. In euchre-style games, the suit joker (the "Master") and the color joker (the "Mistress") act something like built-in right and left bowers, their relative precedence being dependent on whether a hand is played in suits or in colors. In games allowing or requiring wild cards, the three auxiliary cards 24 fill that function, with certain typical restrictions: the suit joker can match any suit but not a color; the color joker can match any color but not a suit; the universal joker (the "Archon") can match suit or color.

Figure 6:
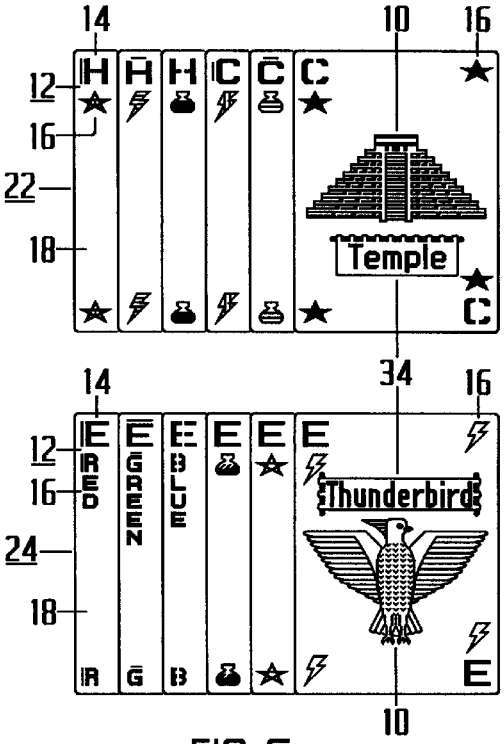
FIG. 6 is a close-up view of two rows of overlapping picture cards.

Description of a Reinforced Deck—FIGS. 1, 5, 6

A reinforced deck of 72 cards is another pluperfect member deck. It comprises the 54-card basic deck (FIG. 1), six standard picture cards (FIG. 5), and 12 gender-neutral, supplemental picture cards (shown in FIG. 6 in two rows of overlapping cards). In the latter group are six normal picture cards 22 and six auxiliary cards 24.

The first row of FIG. 6 comprises two groups of normal picture cards 22; each group is shown, left to right, in the usual color order: red, green, blue. The cards of the first group have an index 14 of "H" and primary indicia 10 (not shown) in the form of neuter humanoid figures. The cards of the second group have an index 14 of "C" and primary indicia 10 in the form of neutral objects (buildings). Each group contains one card of each color and one card of each suit. Together with the normal picture cards shared with the standard deck (FIG. 5), the nine normal picture cards 22 comprise all nine unique combinations of the preferred suits and color groups.

The second row of FIG. 6 comprises six auxiliary cards 24 that can be regarded as elementary jokers. They have an index 14 of "E" and primary indicia in the form of real or imaginary animals. Each of the first three cards has markers 16 in the form of the words, "RED," "GREEN," or "BLUE," indicia colored to match, and no suit symbols. Each of the other three cards bears black indicia and markers 16 of a different one of the three suits. Thus, there is one elementary joker for each suit and, separately, one for each color.

Operation of a Reinforced Deck—FIGS. 1, 5, 6

Operation of a reinforced deck of 72 cards is generally similar to that of the other member decks already discussed. This deck serves several functions better than other decks. Games for six or eight players can benefit from more cards than the standard deck provides. Elaborate melding games can employ more wild cards or more exotic melds. Finally, in nontraditional fantasy games that make heavy use of special rules and individualized powers, a variety of distinct picture cards work better than an increased plurality of number cards.

In general, picture cards in a reinforced deck work like those in the preferred standard deck. Picture cards outrank number cards; jokers outrank normal picture cards. In melding games, each value group is a separate melding group, regardless of other possible functions.

In most games, normal picture cards 22 serve as the highest-valued ordinary cards of their respective suits and color groups; the usual order of rank is "N," "C," "H," from highest to lowest. (The three value groups are approximately equivalent to conventional kings, queens, and jacks.)

All of the elementary jokers have the same nominal value. In trick-taking games, the elementary jokers are the highest-valued cards of their respective nontrump suits and color groups; the relative strength of single-suit jokers versus single-color jokers depends, like two of the ruling jokers, on whether a hand is played in suits or colors. As occasional wild cards, they are more restricted than ruling jokers.

Figure 7A:
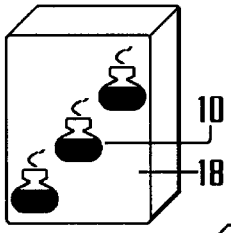
FIGS. 7A to 7C show, in detail, three different versions of a typical tile face.
Figure 7B:
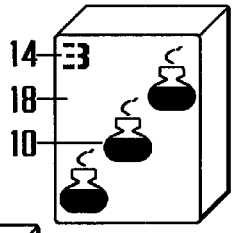
Figure 7C:
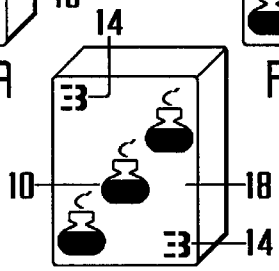

Description of a Tile Set—FIGS. 7A to 7C

An alternative embodiment of my invention is a set of rectangular tiles made of plastic, wood, stone, or similar material. The face is roughly a quarter the size of a conventional playing card, commonly with a width three-fourths of the tile's length. The dimensions of a typical embodiment are 28×21×13 millimeters. A tile must be thick enough to allow it to stand on end.

FIGS. 7A to 7C show three versions of a representative tile equivalent to a number card. None bears set markers 16 or employs the improved layout of FIG. 2A.

FIG. 7A is the simplest; its face comprises primary indicia 10 on a contrasting background 18. In keeping with my preferred color scheme, the background 18 is white, and the identifying color of the indicia correspond to the tile's color group. The shape of the indicia denote the tile's suit.

FIG. 7B shows the preferred, and most common, tile face. To the tile in FIG. 7A, the one in FIG. 7B adds a single value index 14. The position of index 14 is not necessarily the same for all tiles; it is usually in the upper left corner but in some cases is just below the middle of the upper edge of the face.

FIG. 7C shows a tile with a pair of indexes 14 diagonally opposite each other. Although this arrangement is closer to a card's layout, it is uncommon.

Operation of a Tile Set—FIGS. 7A to 7C

With the exception of certain solitaire games, most games played with cards can be played with tiles, and any member deck of cards can be duplicated with a set of tiles. Instead of being shuffled, tiles are spread out face down and mixed. The undealt stock can remain scattered or be neatened into a chain or two-tile-high wall from which replacement tiles are taken. Tiles dealt to a player are kept on the table top or playing surface, standing on edge, so that the faces are visible to that player and nobody else.

Because a group of tiles is not physically held in the hand, secondary indicia are not essential. Because tiles cannot be overlapped, they do not benefit from my improved, four-corner layout.

Figure 8:
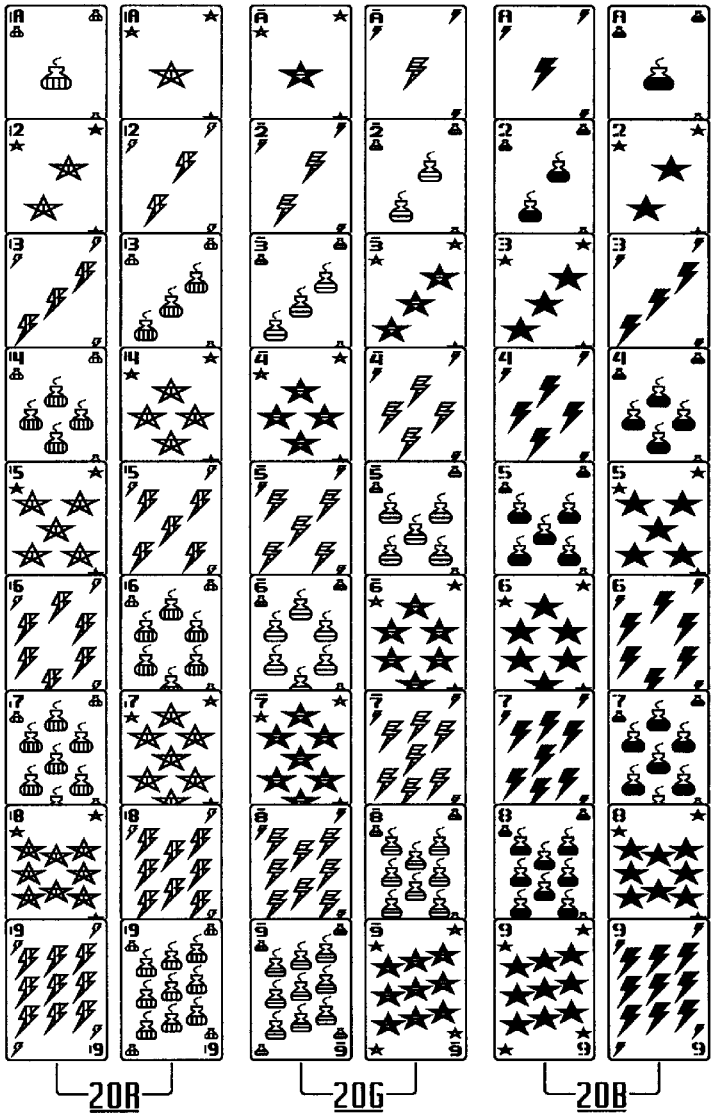
FIG. 8 shows a reduced deck of number cards (slightly overlapping to save space).

Description of a Reduced Deck—FIGS. 5, 6, 8

FIG. 8 shows a reduced deck of 54 number cards, slightly overlapping to save space. It uses the same three suits and colors as the other preferred member decks discussed herein. It comprises nine values but only six cards per value: two of each suit and two of each color group.

The reduced deck shown is an imperfect deck formed by omitting three cards—one of each color group and one of each suit—of each value from a perfect deck. The suit-color combinations missing from one rank are different from those missing from either the next rank or the previous one. Any three successive ranks (values) comprise two sets of the nine possible suit-color combinations.

A reduced deck can be combined with the standard face cards of FIG. 5 or with those and the supplemental face cards of FIG. 6.

Operation of a Reduced Deck—FIGS. 5, 6, 8

Although it is somewhat more limited for solitaire games, a reduced deck generally serves as a reasonable alternative to the basic deck described above. Most multiplayer games that can be played with perfect or pluperfect decks can be played with a deck comprising a reduced deck. Since a reduced deck bears some resemblance to a pinochle deck, conventional card players may find it less strange than a perfect deck.

It has at least one unique use: in the form of a double deck, a reinforced, reduced deck of 144 cards is the basis for an improved melding game in the style of mah jong.

Figure 9:
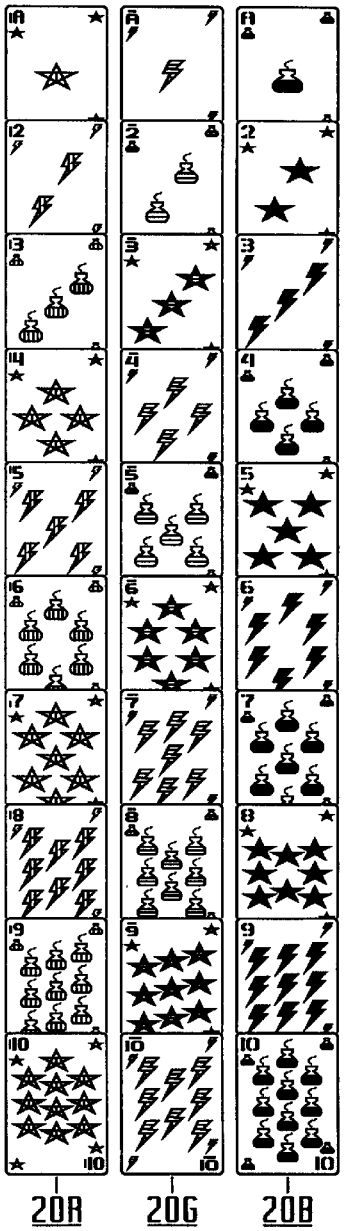
FIG. 9 shows a depleted deck of number cards (slightly overlapping to save space).

Description of a Depleted Deck—FIGS. 5, 6, 9

The depleted deck shown, slightly overlapping, in FIG. 9 is a minimal imperfect deck of 30 number cards, including 10 values. It is, in a sense, the converse of the reduced deck of FIG. 8; each rank comprises only three cards, including one of each suit and one of each color group. It differs from a conventional, "inert" deck in that a suit is not permanently (that is, throughout the deck) matched to a color. The suit-color combinations of one rank are different from those of either the next rank or the previous one. Any three successive ranks (values) comprise all nine possible suit-color combinations.

A depleted deck can be combined with the standard face cards of FIG. 5 (to make deck of 36 cards) or with those and the supplemental face cards of FIG. 6 (to make a deck of 48 cards). Alternatively, the ranks could be increased to 16 (to make a deck of 48 number cards) or 14 (to make a reinforced, depleted deck of 60 cards).

Operation of a Depleted Deck—FIG. 9

A depleted deck does not support quite the variety of games that other member decks do. Play is generally more straightforward, with less uncertainty and less room for tactical decision-making.

For playing solitaire, a depleted deck, even one with more ranks than the one shown in FIG. 9, has few advantages over a conventional deck. For melding games, it is clearly inferior to other member decks. However, because it is closer to a conventional, "inert" deck than reduced or perfect decks are, new players may find it a reasonable transition or introductory deck for discarding or trick-taking games.

Conclusion, Ramifications, and Scope

In any form, my deck is a reasonable alternative to a conventional deck of cards, equally capable of supporting a multitude of games, with a number of advantages, including greater flexibility, superior game play, a better basis for tactical decision-making, an improved layout, user-friendly features, gender neutrality, and a high degree of novelty.

Although the description above contains many specificities, these should not be construed as limiting the scope of the invention; their purpose is to clarify an invention unusually capable of a wide range of embodiments by illustrating some of the currently preferred embodiments and variations thereof. For example, any of the member decks shown could have more or fewer values and, consequently, more or fewer cards or pieces. Triple or quadruple decks, with three or four copies of each card, are possible. A perfect set of normal picture cards could be added to the perfect basic deck shown. Additional markings or changes in value indexes could be used to create additional categories or subcategories of cards or to further distinguish among cards of the same value: to make some aces higher than others, for instance.

An alternative embodiment of any deck could omit one or more preferred features, such as the improved layout, indicative backs, or gender-neutral picture cards, or appear in a form other than cards. The pieces could be blocks, poker-chip equivalents, or cards of unusual size; they could be round, square, or elongated. More unusual shapes, especially if represented on computer, are possible. Alternative colors or suit symbols could be substituted for those shown and described, or color groups could be indicated by changing the color of the background instead of the indicia.

A deck of cards, tiles, or pieces of any shape could be simulated on a computer of any size, a home videogame machine, a dedicated arcade machine, a hand-held device, or any electronic device (disk, tape, cable system, closed-circuit, etc.) connected to a conventional television or similar display.

An odd variation of the preferred decks of cards would involve doubling (to six) the number of colors or suits (but not both). A perfect deck of that sort may not be practical, but a reduced deck, with nine cards per value, would largely resemble the basic deck described above. It offers no obvious advantages over the preferred variations, but it could be done.

A conventional deck could be made trilateral by making its colors and suits independent, yielding a perfect deck with eight cards per value or an imperfect (depleted) deck that kept four cards per value. The latter deck would greatly resemble the standard one, except that every other rank would feature black diamonds and hearts and red spades and clubs. With four colors (red, green, blue, and black, perhaps), the same four suits and only four values could produce a perfect 64-card deck with 16 cards per value. However, such a deck would not work as well for most games as reduced decks, with eight or 12 cards per value, or a depleted deck having only four cards per value.

A variety of other trilateral decks seem feasible: for example, a four-suit, three-color (or three-suit, four-color) deck with 12 (if perfect), six (reduced), or conceivably only three (depleted) cards per value; a three-suit, two-color (or two-suit, three-color) deck with six (perfect) or three (imperfect) cards per value; or even a six-suit, two-color deck with 12 (perfect) or six (imperfect) cards per value. Most would be interesting and workable, but none seem as flexible and generally useful as the preferred triadic variations. Odder combinations, like five suits and two colors, are possible but offer fewer advantages.

Accordingly, the scope of the invention should be determined by the appended claims and their legal equivalents, rather than merely by the examples given.

I claim:

1. A trilateral collection of playing pieces, comprising three independent organizing dimensions or ordering sets or aspects, comprising two primary aspects, including suits and color groups, and a secondary aspect of numbers or ranks or values, each of said aspects comprising a plurality of elements, wherein each of said primary aspects, being generally equal in priority or importance to the other of said primary aspects, comprises an equal plurality of elements, an additional substantially equal plurality of values, and a further substantially equal plurality of said playing pieces, said plurality of elements of said secondary aspect is at least as great as said plurality of elements of each of said primary aspects, said plurality of elements of each of said aspects is at least three, each of said suits, being generally equal in priority or importance to every other of said suits, comprises a substantially equal set of said values and a substantially equal plurality of said playing pieces, each of said color groups, being generally equal in priority or importance to every other of said color groups, comprises a substantially equal set of said values and a substantially equal plurality of said playing pieces, each of said suits comprises substantially the same plurality of said playing pieces comprised by each of said color groups, each of said suits comprises a set of said values similar to that comprised by each of said color groups, each of said suits comprises an approximately equal plurality of said playing pieces in each of said color groups, each of said color groups comprises an approximately equal plurality of said playing pieces in each of said suits, each of at least a majority of said values comprises at least one of said playing pieces from each suit and at least one of said playing pieces from each color group, each of said playing pieces comprises a pair of opposite surfaces substantially equal in size and shape, the first of said opposite surfaces constituting a front or face, and the other of said opposite surfaces being a reverse or back, each of at least a preponderance of said playing pieces bears on said face indicia and a distinguishing color scheme, said indicia and said distinguishing color scheme, in combination, being generally sufficient to designate any combination of a single one of said suits, a single one of said color groups, a single one of said values, and said playing pieces comprise a plurality of number pieces, said number pieces being at least approximately equivalent to number cards, and a separate plurality of picture pieces, said picture pieces being at least approximately equivalent to picture cards or face cards, and said picture pieces comprise a plurality of normal picture pieces, a separate plurality of auxiliary pieces, and a further plurality of said values, the value of said picture pieces being generally higher than the value of said number pieces, whereby a multitude of challenging and diverting games may be played.

2. The collection of playing pieces of claim 1 wherein each of said playing pieces is substantially rectangular, further comprising four edges, said edges being smaller than said face, said distinguishing color scheme comprises at least one background color and at least one dominant indicia color, said primary indicia on each of said number pieces are pips, the plurality thereof corresponding to the value of said number piece, the shape thereof designating the suit of said number piece, each of said number pieces and each of said normal picture pieces represent a predetermined combination of a single one of said suits, a single one of said color groups, and a single one of said values, the value of said auxiliary pieces is generally higher than the value of said normal picture pieces, each of said backs bears a design and a color scheme, said color scheme comprising at least one color, and said design and said color, individually and in combination, being insufficient to identify a single one of said aspects, and said collection is a superset comprising a plurality of subsets of said playing pieces having exactly the same primary aspects as said superset, wherein each of said suits comprises a substantially equal plurality of said playing pieces, a sustantially equal set of values, and an approximately equal plurality of said playing pieces in each of said color groups, each of said color groups comprises a substantially equal plurality of said playing pieces, a sustantially equal set of values, and an approximately equal plurality of said playing pieces in each of said suits, each of said suits comprises substantially the same plurality of said playing pieces comprised by each of said color groups, each of said suits comprises a set of values substantially similar to that comprised by each of said color groups, each of said values comprising at least one of said number pieces comprises an identical plurality of said number pieces, at least one of said subsets consists of 54 of said playing pieces, a plurality of said subsets comprise a plurality of said picture pieces per value that is less than the plurality of said number pieces per value, and a further plurality of said subsets comprise a plurality of said auxiliary pieces approximately equal to said plurality of normal picture pieces, whereby each of said subsets of playing pieces is generally sufficient to allow at least one game to be played.

3. The superset of playing pieces of claim 2 wherein said plurality of suits is three, said plurality of color groups is three, said plurality of values is at least six, said plurality of normal picture pieces is a multiple of three, said plurality of auxiliary pieces is a multiple of three, said distinguishing color scheme further comprises three dominant indicia colors, each comprising at least one shade and designating a different one of said color groups, said at least one background color is one background color, said background color being common to all of said faces of said playing pieces, at least a preponderance of said subsets comprises a multiple of three of said playing pieces, a plurality of said subsets comprises a multiple of three of said values, a separate plurality of said subsets consists of a multiple of three of said number cards, and a further plurality of said subsets comprises a plurality of said number cards and a separate plurality of said picture cards, each of said pluralities being a multiple of three, whereby a wide variety of games may be played by three players without having to remove any of said playing pieces from the set of said playing pieces customarily used in each of such games.

4. The superset of playing pieces of claim 3 wherein said playing pieces are tiles, each of said tiles comprising a length of 2 to 6 centimeters, a width of about three-quarters of its length, and a thickness sufficient to allow the tile to stand on edge, whereby said indicia-bearing face can be seen by one player while remaining hidden from others.

5. The superset of playing pieces of claim 3 wherein said playing pieces are simulated on an electronic device capable of being connected to a video display, said video display being reasonably capable of displaying a recognizable image of said playing pieces, and all of said indicia, including those disposed in the lower half of said playing pieces, share a common orientation, the tops of said indicia being closer to the top edge than to the bottom edge of each of said playing pieces, whereby recognition of said indicia may be improved over the conventional use of inverted lower indicia on the faces of standard playing cards and common electronic representations thereof.

6. The superset of playing pieces of claim 3 wherein said superset is a master deck of playing cards of conventional size and shape, said subsets are member decks, said number pieces are number cards, said picture pieces are picture cards, said normal picture pieces being normal picture cards and said auxiliary pieces being auxiliary cards or jokers, said picture cards comprising an equal plurality of male and female images, and each of said values of said picture cards comprising an equal plurality of male and female images, said indicia comprise primary indicia disposed on the main or central portion of said face and a plurality of sets of secondary indicia, each of said sets of secondary indicia comprising a value index and a set designation marker, the two elements being vertically aligned and disposed along a vertical or side edge of said face, and said value indexes in two of said sets of secondary indicia being disposed in diagonally opposite corners of said face, said background color is white, and said distinguishing color scheme further comprises a plurality of neutral or common colors, said neutral colors being usable, nonindicatively, on cards of all color groups for shading, highlighting, and visual clarity, and at least one of said neutral colors being used, indicatively, on at least the value index of a plurality of said auxiliary cards, to indicate or identify those of said auxiliary cards that are not affiliated with any one of said color groups, whereby a wide variety of solitaire and multiplayer card games may be played, and, in the guise of entertainment, the ideals of sexual equality and gender equity may be fostered.

7. The master deck of claim 6, wherein said shapes designating said suits comprise a laboratory flask or beaker, a five-pointed star or pentacle, and a stylized thunderbolt or lightning bolt, said three dominant indicia colors are red, green, and blue, said neutral colors include black, white, and shades of gray, said secondary indicia further include two set designation markers, each disposed in a corner horizontally opposite one of said value indexes, so that, when a plurality of said cards is vertically overlapped by a margin just sufficient to expose one of said value indexes on one of said cards otherwise covered or concealed, exactly one of said value indexes and one of said set designation markers will be visible on said card, and the disposition of said secondary indicia on each of said cards is substantially symmetrical diagonally but asymmetrical horizontally and vertically, the immediate area of any two adjacent corners of any of said cards comprising dissimilar indicia, whereby the added set designation markers allow said cards, as in a game of solitaire, to be overlapped vertically more closely than conventional playing cards can be without obscuring the rank or suit of any of the overlapped cards.

8. The master deck of claim 7 wherein each of said cards bears an indicative back comprising said design and said color scheme, said color scheme being an indicative color scheme, and said indicative back being the same for all of said cards in each of said member decks and different for cards in different member decks, and said member decks further comprise a plurality of single decks, each of said single decks comprising 18 to 100 of said playing cards, each of said cards being different from every other card in the same single deck, and an additional plurality of double decks, each of said double decks comprising two substantially identical copies of each of said playing cards in said double deck, each of said single decks being capable of spawning exactly one of said double decks, each of said double decks duplicating a different one of said single decks by comprising two substantially identical copies of each of said playing cards in its parent single deck, so that each of said double decks comprises every value and exactly twice the plurality of said playing cards comprised by its parent single deck, and each of said member decks consisting of a set of cards different from the set of cards making up every other of said member decks, in that most of said member decks comprise different pluralities of said playing cards, and, for any two of said member decks comprising identical pluralities of said playing cards, at least one of said playing cards present in one of said member decks is missing from the other, whereby the variety of said member decks accommodates a range of games and player pluralities greater than that allowed by any fixed deck.

9. The master deck of claim 8 wherein the back of each of said cards in each of said single decks bears the same design as every other card in said single deck, a plurality of said designs comprise a plurality of design elements including a crown symbol, a product title logo, and a symmetrical and repetitive background pattern such as a checked pattern, said design elements providing information about the configuration of each of said member decks, including the presence of picture cards and the perfection of the deck, and said design elements, in combination, being generally sufficient to distinguish one of said single decks from any other of said single decks, each of said single decks employs a unique design, sufficiently different from the design employed by any other of said single decks to reasonably prevent confusion between them, each of said double decks comprises the same design as its parent single deck, said indicative color scheme is the same for all of said single decks, said single decks and said double decks have different indicative color schemes, and said indicative color scheme includes black, white, shades of gray, and a dominant or indicative color, one of said indicative colors designating a single deck and a different one of said indicative colors designating a double deck, whereby players of a new game can know which cards are in use.

10. The master deck of claim 9 wherein a simple one of said designs comprising a background pattern of diamond shapes designates a basic deck of 54 number cards, said crown symbol indicates the presence of six of said picture cards in one of said single decks, a pair of said crown symbols indicates the presence of 18 of said picture cards in one of said single decks, a diagonally disposed product title logo designates a reduced deck comprising fewer than nine number cards of each value in one of said single decks, and said indicative color is blue for said single decks and reddish-brown for said double decks.

11. The master deck of claim 10, further comprising a perfect single deck consisting of 54 number cards, each of said cards representing a unique combination of a single one of said suits, a single one of said color groups, and a single one of said values, six of said values, including 1 or ace, 2, 3, 4, 5, and 6, all of said unique combinations of the three suits, three color groups, and six values, nine of said cards of each of said values, including three in each of said suits and three in each of said color groups, 18 of said cards in each of said suits, including six in each of said color groups, and 18 of said cards in each of said color groups, including six in each of said suits, whereby a plurality of introductory games, a multitude of solitaire games, and substantially all conventional dice games can be played.

12. The master deck of claim 10, further comprising a pluperfect single deck comprising 54 number cards, each of said cards representing a unique combination of a single one of said suits, a single one of said color groups, and a single one of said values, six of said values, including 1 or ace, 2, 3, 4, 5, and 6, and all of said unique combinations of the three suits, three color groups, and six values, and further including a plurality of said normal picture cards, an equal plurality of said auxiliary cards, and a further plurality of said values, said normal picture cards comprising at least three of equal value, including one of said cards in each of said suits, and one of said cards in each of said color groups, and said auxiliary cards comprising three ruling jokers of equal value, said value indexes thereof being predominantly black, including one of said jokers denoting all of said suits, a second said joker denoting all of said colors, and a third said joker denoting all of said suits and all of said color groups.

13. The master deck of claim 12, further comprising a member deck of 72 of said cards, including all of said cards in said pluperfect single deck and an additional 12 of said picture cards, for a total of 18 such cards, including nine normal picture cards and nine auxiliary cards, said normal picture cards comprising three of said values, all nine combinations of a single one of said suits and a single one of said color groups, one of said cards of each value in each suit, and one of said cards of each value in each color group, and said auxiliary cards comprising said three ruling jokers and six elementary jokers of equal lower value, each of said elementary jokers denoting a single element of said primary aspects, including one of said elementary jokers in each of said suits, said secondary indicia thereof being predominantly black, and one of said elementary jokers in each of said color groups.

14. The master deck of claim 10, further comprising a reduced single deck comprising 54 number cards, each of said number cards representing a unique combination of a single one of said suits, a single one of said color groups, and a single one of said values, nine of said values, including 1 or ace and 2 through 9, exactly six of said number cards of each of said values, including two in each of said suits and two in each of said color groups, 18 of said number cards in each of said suits, including six in each of said color groups, 18 of said number cards in each of said color groups, including six in each of said suits.

15. The master deck of claim 10, further comprising a depleted single deck comprising 30 number cards, each of said number cards representing a unique combination of a single one of said suits, a single one of said color groups, and a single one of said values, 10 of said values, including 1 or ace and 2 through 10, exactly three of said number cards of each of said values, including one in each of said suits and one in each of said color groups, 10 of said number cards in each of said suits, including at least three in each of said color groups, 10 of said number cards in each of said color groups, including at least three in each of said suits.

16. A deck of playing cards of conventional size and shape, comprising at least 18 number cards, a plurality of suits and a similar plurality of color groups, wherein the number of suits and the number of color groups are equal, exactly six numbers or values, including 1 or ace, 2, 3, 4, 5, and 6, and an equal plurality of said cards in each of said values, each of said cards bearing on its face indicia of value and suit and a distinguishing color scheme, said indicia and said color scheme, in combination, being generally sufficient to designate any combination of a single one of said suits, a single one of said color groups, and a single one of said values, whereby a plurality of card games for three players and, by substituting said cards for standard dice, substantially all conventional dice games can be played.

17. The deck of cards of claim 16, wherein said plurality of suits is three, said plurality of color groups is three, each of said suits, being generally equal in priority or importance to each of said color groups, comprises a set of said values similar to that comprised by each of said color groups, said indicia comprise primary indicia disposed on the central portion of said face and a set of secondary indicia in each of two diagonally opposite corners, said primary indicia being pips, the plurality thereof corresponding to the value of each card, the shape thereof designating the suit of each card, and said set of secondary indicia comprising a value index and a suit or set designation marker, and said deck is a perfect deck consisting of 54 number cards, each of said cards representing a unique combination of a single one of said suits, a single one of said color groups, and a single one of said values, all of said unique combinations of the three suits, three color groups, and six values, nine of said cards of each of said values, including three in each of said suits and three in each of said color groups, 18 of said cards in each of said suits, including six in each of said color groups, and 18 of said cards in each of said color groups, including six in each of said suits, whereby a plurality of introductory games, a multitude of solitaire games, common and improved dice games, and card games especially suited to three, six, or nine players can be played.

* * * * *